US010759189B2

(12) United States Patent
Mueller et al.

(10) Patent No.: US 10,759,189 B2
(45) Date of Patent: Sep. 1, 2020

(54) METHOD FOR DETERMINING WEARING OF A PRINTING APPARATUS AND PRINTING APPARATUS

(71) Applicant: Bizerba SE & Co. KG, Balingen (DE)

(72) Inventors: Jochen Mueller, Albstadt (DE); Urs-Michael Schaudt, Albstadt (DE); Gerd Kammerer, Zimmern ob Rottweil (DE); Helmut Pfau, Bodelshausen (DE); Markus Uber, Pfullingen (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 16/548,882

(22) Filed: Aug. 23, 2019

(65) Prior Publication Data

US 2020/0062005 A1 Feb. 27, 2020

(30) Foreign Application Priority Data

Aug. 27, 2018 (EP) ..... 18191042

(51) Int. Cl.
*B41J 3/407* (2006.01)
*B41J 29/393* (2006.01)

(52) U.S. Cl.
CPC ..... *B41J 3/4075* (2013.01); *B41J 29/393* (2013.01)

(58) Field of Classification Search
CPC ..... B41J 3/4075; B41J 29/393
USPC ..... 347/215
See application file for complete search history.

(56) References Cited

U.S. PATENT DOCUMENTS

| | | | | |
|---|---|---|---|---|
| 10,459,671 | B2 * | 10/2019 | Cook | G06K 15/186 |
| 2003/0053835 | A1 | 3/2003 | Bernhard et al. | |
| 2005/0036817 | A1 * | 2/2005 | Wilken | B41J 11/46 400/582 |
| 2013/0249991 | A1 * | 9/2013 | Iwahara | G06F 3/1259 347/16 |
| 2015/0091966 | A1 | 4/2015 | Nagaoka | |
| 2017/0274679 | A1 * | 9/2017 | Nitta | B41J 3/4075 |
| 2018/0079231 | A1 | 3/2018 | Nagaoka | |

FOREIGN PATENT DOCUMENTS

EP 1278641 B1 9/2007

* cited by examiner

*Primary Examiner* — Huan H Tran
*Assistant Examiner* — Alexander D Shenderov
(74) *Attorney, Agent, or Firm* — Leydig, Voit & Mayer Ltd.

(57) ABSTRACT

A method determines wearing of a printing apparatus. The method includes: controlling a motor of a label paper driving mechanism of the printing apparatus using motor control data; determining a label start indicator; determining a label end indicator; determining a label length indicator corresponding to a length covered by a rotation of the label paper driving mechanism of an unweared printing apparatus between the label start indicator and the label end indicator based on the motor control data; storing the label length indicator; and determining a wearing indicator of the printing apparatus based on stored label length indicators, including the label length indicator.

16 Claims, 4 Drawing Sheets

METHOD FOR DETERMINING WEARING OF A PRINTING APPARATUS AND PRINTING APPARATUS

CROSS-REFERENCE TO RELATED APPLICATIONS

Priority is claimed to European Patent Application No. EP 18 191 042.3, filed on Aug. 27, 2018, the entire disclosure of which is hereby incorporated by reference herein.

FIELD OF THE INVENTION

The present invention relates to a method for determining wearing of a printing apparatus, to a printing apparatus including a printing mechanism for printing label paper and to a system including a printing apparatus and a computing cloud.

BACKGROUND

The section introduces aspects that may be helpful in facilitating a better understanding of the invention. Accordingly, the statements of this section are to be read in this light and are not to be understood as admission about what is in the prior art.

A printing apparatus for printing label paper includes a label paper driving mechanism, which is for transporting the printing material. The printing material is a strip of multiple consecutive self-adhesive labels which is wind up to a roll. The roll includes a backing strip, the so-called liner paper, wherein the labels are stuck to the backing strip and are separated from one another. Self-adhesive label paper rolls without a backing strip, the so-called linerless label paper rolls, include a running, adhesive strip of printing material. The label paper roll is unwind in the printing apparatus and transported by the label paper driving mechanism through the printing apparatus to a print head. The print head prints information on the label paper and then, the label is ejected in an eject section of the printing apparatus. For both cases, liner and linerless label paper, the paper is transported by a driven roller, which is a platen roller or a drawing off roller. Further rollers exist for defining the path of the label paper through the printing apparatus. During time and by printing multiple labels, especially driven rollers are subject to wearing and thus need to be replaced from time to time.

A printing apparatus is known from EP1278641B1. The printing apparatus has multiple rollers in a paper driving mechanism. In case of wearing of the rollers, they can be replaced conveniently and without tools by an operator.

The question how to determine if a roller needs to be replaced is not really addressed in the art. Common methods are to replace certain parts of the printing apparatus after a certain time or a certain number of operating hours. As the wearing is subject to the size and quality of the label paper, the quality of the rollers and the printing apparatus itself and other parameters like printing speed and the like, such a time cannot be exactly determined and there is a risk that parts are replaced to early or too late. Other methods are that if the printed image shows some defects, certain parts of the printing apparatus, which are subject to wearing, are replaced. In this case, a number of labels have been printed and do not have an adequate quality.

SUMMARY

An embodiment of the present invention provides a method that determines wearing of a printing apparatus. The method includes: controlling a motor of a label paper driving mechanism of the printing apparatus using motor control data; determining a label start indicator; determining a label end indicator; determining a label length indicator corresponding to a length covered by a rotation of the label paper driving mechanism of an unweared printing apparatus between the label start indicator and the label end indicator based on the motor control data; storing the label length indicator; and determining a wearing indicator of the printing apparatus based on stored label length indicators, including the label length indicator.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
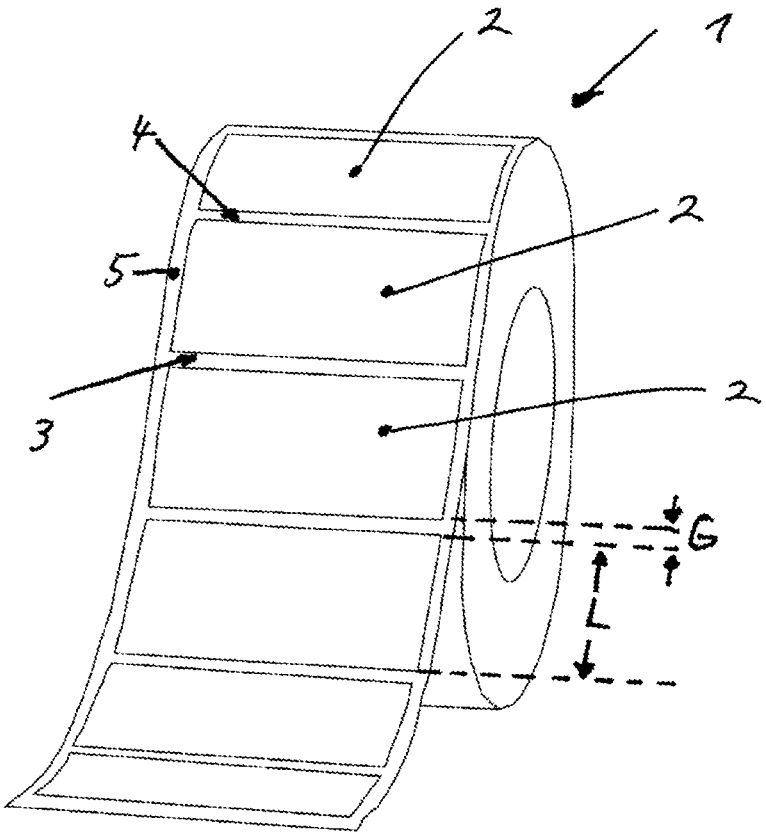
FIG. 1 schematically depicts a label paper roll with multiple consecutive self-adhesive labels.

Embodiments of the present invention determine and give information about wearing of parts of a printing apparatus, especially about wearing of driven rollers.

An embodiment of the present invention concerns a method for determining wearing of a printing apparatus. The method includes the step of controlling a motor of a label paper driving mechanism of the printing apparatus using motor control data. The method further includes the steps of determining a label start indicator and determining a label end indicator. The label start indicator indicates the start position of a label and the label end indicator indicates the end position of the same label. As the label paper roll as described above includes multiple successive labels, it is understood that multiple label start indicators and multiple label end indicators are determined when a label paper roll is transported through the printing apparatus. In one embodiment, a label start indicator and a label end indicator are determined from sensor signals of different sensors. In one embodiment, a label start indicator and a label end indicator are determined from sensor signals of the same sensor, e.g. a label edge sensor. It is clear to a person skilled in the art that the first indicator which is received is a label start indicator and a consecutive indicator which is received is a corresponding label end indicator. In one embodiment, the label start indicator indicates the start position of a label and the start position of a consecutive label is uses as label end indicator. It is clear that the label end position of the previous label is at a defined distance to the label start position of the consecutive label. The method further includes the step of determining a label length indicator. In one embodiment, the label length indicator corresponds to the length covered by the rotation of the label paper driving mechanism of an unweared printing apparatus between the label start indicator and the label end indicator based on the motor control data, which means between the time a label start indicator is determined and a label stop indicator is determined. In other words, according to one embodiment, if there is an unweared printing apparatus, its behavior of the label paper driving mechanism is known. By applying motor control data to a motor of the driving mechanism, a driven roller is driven. By using the motor control data, the rotation of the driven roller can be calculated. The label length indicator is calculated as a function of this rotation. The label length indicator is a calculated length of paper, which is transported according to the motor control data by a driven roller of an unweared printing apparatus. In one embodiment, the label length indicator is simply the number of degrees the driven roller has turned according to the motor control data. In this embodiment, the transported label length is not explicitly calculated. The label length indicator is stored in the next step. From the stored label length indicators, a wearing indicator of the printing apparatus is determined. In one embodiment, multiple and historic label length indicators are compared in order to determine the wearing indicator.

Wearing of the label printing apparatus and especially of the label paper driving mechanism may have multiple sources. A driven roller like a platen roller or drawing off roller is e.g. made of a synthetic material. During time, this material may harden and therefore its friction coefficient may decrease. Further, abrasion may affect and reduce the diameter of the roller slightly. This may lead to the fact that the paper length transported per rotation of the driven roller slightly decreases during time. Further, the motor is coupled to the driven roller by a coupler, which may be affected by wearing effects.

On the other hand, the motor controller drives the label paper driving mechanism based on an input of a label edge sensor or a blackmark sensor. The motor and the print head are controlled until the label printing is finished. As long as the above mentioned wearing effects are small, they do not affect the printed image. If these effects are too big, the printed image is affected, as the wearing effects cannot be addressed by the motor controller. This means, the control data sent to the print head are correlated with the motor control data, but the label is not transported in a way the motor control data suggest, which worsens the quality of the printed image. Also the calculated label length indicator gives not the real label length but a label length derived from the motor control data, which would be realistic without any wearing. The time which is needed for the transportation of one label is derived from the label start indicator and the label stop indicator. If the same label is transported in the label paper driving mechanism once in a label paper driving mechanism without any wearing and once in a label paper driving mechanism which suffers from wearing, the time between the label start indicator and the label end indicator slightly increases, if the motor is operated by the same speed in both cases. As a consequence, the label length indicator also slightly increases. These label length indicators are stored. By inspecting the shift of the label length indicator during time, a measure for wearing of the printing apparatus is established. Of course, different label lengths have to be taken into account, but as the shift of the label length indicator caused by wearing is much less than the length difference from one label to another, different label lengths can be handled by the method. The above is true for the case that the label length indicator is a number of degrees turned by a driven roller and for the case that a label length is derived therefrom by assuming an unweared system.

According to one embodiment, the label start indicator and the label end indicator are determined by a label edge sensor or a blackmark sensor. The label edge sensor or the blackmark sensor are needed for controlling the printing process. The output of the sensor is used to coordinate the control of the print head. Thus, no additional sensor hardware is needed for the method. The hardware output of the label edge sensor or the blackmark sensor can be reused as input for the method.

According to one embodiment, the printing apparatus has an internal clock and the label start indicator and the label end indicator are time stamps based on the internal clock of the printing apparatus. The internal clock of the printing apparatus may also be a time source provided by an external entity but used by the printing apparatus as internal time reference.

According to one embodiment, the label length indicator corresponds to the number of rotations of a platen roller and/or drawing off roller of the label paper driving mechanism within the time frame between the label start indicator and the label end indicator. It is understood that the number of rotations does not mean an integer number of full rotations of the roller. Rather, it is a measure how much degrees the roller rotated. It is not necessary to calculate a real length from the number of rotations and the diameter of the unweared platen roller and/or drawing off roller.

According to one embodiment, the step of storing the label length indicator includes the step of updating with a determined label length indicator an envelope function representing historic label length indicators of a predefined time interval. It is advantageous to evaluate a statistical value of the label length indicator. Therefore, an envelope function (envelope curve, envelope) is used to reflect multiple label length indictors calculated during a defined time interval to represent a statistic of this measure. It is not necessary to determine and store a label length indicator of each and every label which is printed. Therefore, according to one embodiment, in order to safe computational power, only one label length indicator is determined each minute or one label length indicator is determined for every tenth or twentieth label. To generate an envelope of the label length indicator in the printer reduces storage which is needed to store the label length indicator information. According to one embodiment, the envelope is stored as numeric data, e.g. as a matrix or a vector.

Subject to average use conditions, the printing apparatus is used between three and five hours a day. A platen roller or drawing off roller needs to be replaced after one year. Thus, it is sufficient to generate and store a couple of label length indicators and/or envelopes thereof once a day, or once every couple of days in order to determine the wearing indicator.

According to one embodiment, local maxima of the envelopes are determined.

According to one embodiment, label length indicators are transmitted to a computing cloud or to a server. According to one embodiment, the envelopes are transmitted to a computing cloud or a server. According to one embodiment, the local maxima of the determined envelopes are transmitted to a computing cloud or a server. According to one embodiment, these transmissions are executed on a regular basis, e.g. every day or every week. According to one embodiment, these transmissions are executed as requested by a network.

According to one embodiment, the wearing indicator is determined on the basis of the shift of the label length indicators. According to one embodiment, the wearing indicator is determined on the basis of the shift of the corresponding envelopes. According to one embodiment, the wearing indicator is determined on the basis of the shift of the maxima of corresponding envelopes.

According to one embodiment, the label length indicator, the corresponding envelope and/or the maxima of the corresponding envelope are compared to length data of a data base related to the label. From the label length indicator and the diameter of the driven roller, e.g. the platen roller or the drawing off roller, a real distance which is covered by the roller between the label start indicator and the label stop indicator is calculated. As from the data base a real label length is known, the difference between the distance covered by the roller and the length of the label gives a measure for wearing of the label paper driving mechanism. As wearing effects increase, the difference between the distance covered by the roller and the label length increases.

According to an embodiment of the invention, a printing apparatus is provided. The printing apparatus includes a printing mechanism for printing label paper, in particular in the form of label paper rolls. The printing apparatus includes a print head unit for printing on the label paper, e.g. via thermal direct printing or thermal transfer printing or the like. A label paper driving mechanism of the printing apparatus includes at least a motor and a driven transport roller, in particular a driven platen roller (print roller) or a driven drawing off roller. The printing apparatus further includes a label edge sensor and/or a blackmark sensor. A label edge sensor is able to detect an edge of a label which sticks on a liner paper. In most cases, the same label edge sensor is used to detect a front edge and a rear edge. Alternatively, a separate label edge sensor may be used for detecting the front edge and the rear edge. The label edge sensor detects the edge of the label when the label passes the sensor during transport in the label path of the printing apparatus. A blackmark sensor is a sensor which detects a mark, which is usually a black bar at the edge of the label on the front side or the rear side of the label paper roll. Of course, a blackmark may also indicate the middle of the label. In this case, if the middle of the label and also the label length is known, also the front edge and the rear edge is known. The printing apparatus further includes a processor with at least an input for receiving motor control data and an input for receiving an output of the label edge sensor and/or blackmark sensor. The processor further includes a calculator for calculating a label length indicator. Basis for the calculation of the label length indicator are motor control data and the received signal of the label edge sensor and/or the blackmark sensor. In one embodiment, the label length indicator is a real length of the label. In one embodiment, the label length indicator is a measure which directly corresponds to the label length, e.g. a number of turns of a driven roller which transports the label paper or a number of degrees the driven roller has rotated to pass the label below the label edge sensor from the front edge to the rear edge. The label length indicator for describing the length of the label are calculated on the basis an unweared printing apparatus. This means, no wearing effect is considered when calculating the label length indicator irrespective of the fact if the printing apparatus suffers from wearing or not. The label length indicator corresponds to the length covered by the rotation of the label paper driving mechanism, in particular the platen roller and/or the drawing off roller, when the label paper driving mechanism is controlled by the motor control data between the time of receiving a label start indicator and a label end indicator from the label edge sensor and/or blackmark sensor. As described above, also if a label start indicator and a label end indicator may be the same output signal of the label edge sensor and/or blackmark sensor, it is known if the front edge or the rear edge is detected, as a rear edge always follows a front edge. The printing apparatus further includes a storage for storing label length indicators.

According to one embodiment, the printing apparatus has an internal clock and the label start indicator and the label end indicator are time stamps based on the internal clock of the printing apparatus. The internal clock of the printing apparatus may also be a time source provided by an external entity but used by the printing apparatus as internal time reference.

According to one embodiment, the processor includes an envelope calculator for determining an envelope representing label length indicators calculated during a predetermined time interval and for calculating local maxima of the envelope.

According to one embodiment, the processor further includes a determinator for determining a wearing indicator of the printing apparatus based on stored historic length indicators, envelopes and/or maxima of envelopes.

According to one embodiment, the printing apparatus includes a transmitter for repeatedly transmitting label length indicators and/or envelopes representing label length indicators and/or local maxima of the envelopes representing label length indicators to a computing cloud. In particular, the transmitter is a LAN, WLAN or other network technology which provides access to the internet and/or to a computing cloud.

An embodiment of the present invention further provides a system for determining wearing of a printing apparatus. The system includes at least one printing apparatus as described above. The system further includes a computing cloud. The computing cloud includes at least one data storage unit which includes at least one memory device. The memory device is configured to store instructions and data. The computing cloud further includes at least one computer processing unit configured to execute the instructions which are stored in the at least one memory device. The computing cloud is configured to receive label length indicators and/or envelopes representing label length indicators and/or local maxima of envelopes representing label length indicators. The computing cloud is configured to detect shift of the received label length indicators and/or the received envelopes and/or the received local maxima. The computing cloud is further configured to determine a wearing indicator of at least one printing apparatus based on the detected shifts. The computing cloud is further configured to instruct at least one client device associated with the computing cloud if the wearing indicator reaches a first threshold and/or the deviation of the wearing indicator reaches a second threshold.

Embodiments of the present invention are described below in relation to the drawings. The description and drawings merely illustrate principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventors to furthering the art, and are to be construed as being without limitation to such specifically recited examples and conditions. Moreover, all statements herein reciting principles, aspects and embodiments of the invention, as well as specific examples thereof, are intended to encompass equivalents thereof.

FIG. 1 schematically depicts a label paper roll 1 with multiple consecutive self-adhesive labels 2, which are arranged on a backing strip 5 (a strip of backing paper). The labels 2 have a certain label length L. Each label 2 has in an unwinding direction of the label paper roll a front edge 3 and at the opposite side a rear edge 4. Between the rear edge 4 of one label 2 and the front edge 3 of the following label 2, a gap with the distance G is available.

Figure 2:
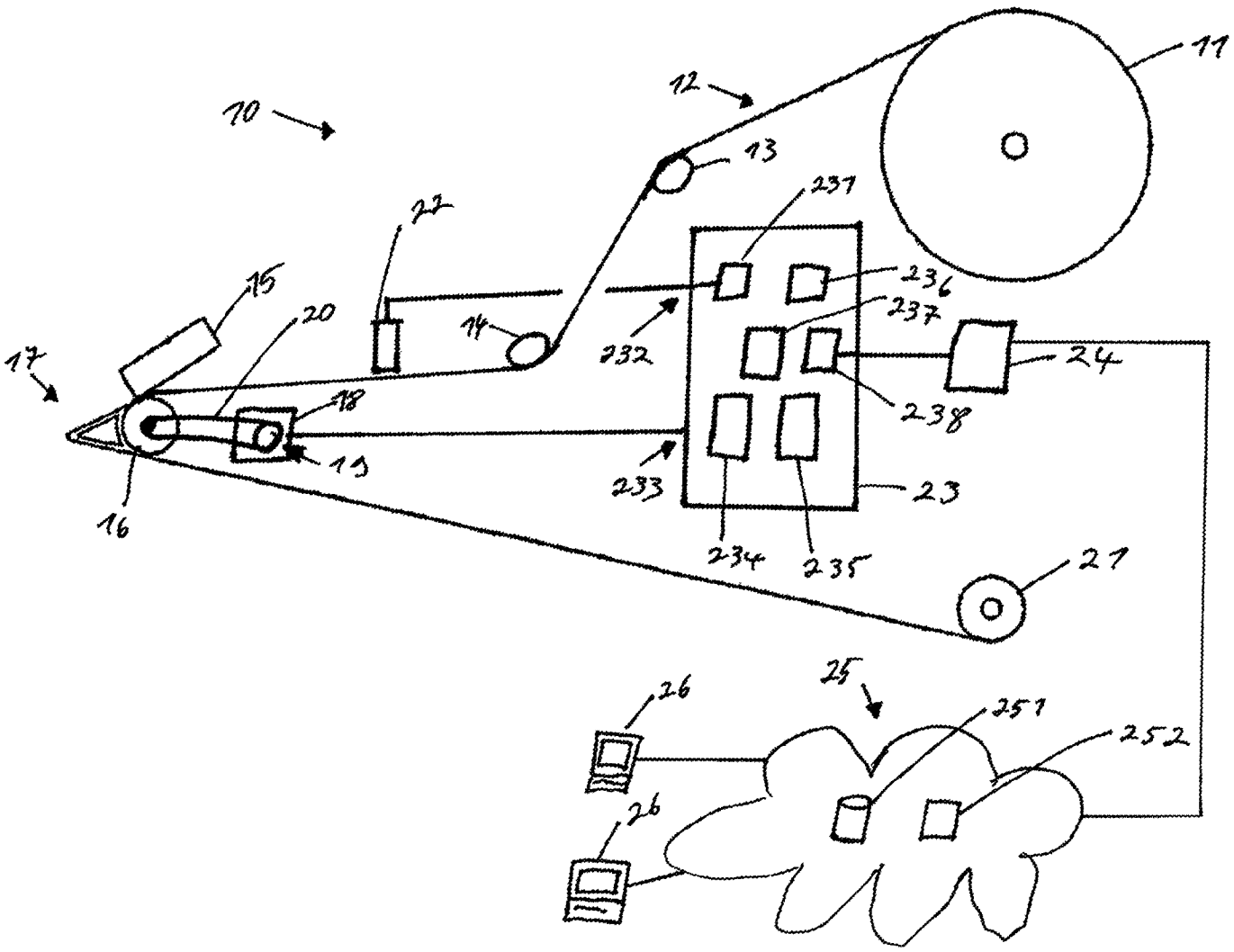
FIG. 2 schematically depicts a printing apparatus and a system including a printing apparatus and a computing cloud according to the invention.

FIG. 2 schematically depicts a printing apparatus 10. The printing apparatus 10 includes a mounting section for mounting a label paper roll 11. From the label paper roll 1, 11, a backing strip 5 including labels 2 is unwind and is fed along the label paper path 12 through the printing apparatus 10. The label paper path 12 is defined by certain rollers 13, 14, 16 from the label paper roll 11 to a roller 21 for winding up the backing strip 5. The printing apparatus 10 includes a print head 15 for printing. In case of thermal direct printing, a platen roller 16 is present at the opposite side of the print head 15. The platen roller 16 is a driven roller and is for transporting the backing strip 5 including the labels 2 through the label paper path 12. In case linerless labels are used, no backing strip is available and no roller 21 for winding up the backing strip 5 is present. In case of thermal transfer printing, a thermal ribbon (not shown) is used for printing. Instead or in addition to the platen roller 16, a drawing off roller (not shown) may be present. All these variations of printers are examples for a printing apparatus in which the invention may be implemented. The platen roller 16 is driven by a motor 18. The motor 18 is mechanically connected to a belt 20 by a coupler 19. The belt 20 drives the platen roller 16. Beside the platen roller 16 or drawing off roller, also the coupler 19 and the belt 20 and other parts of the printing apparatus 10 are subject to wearing, which can be determined according to the invention. A motor controller defines the rotation of the motor 18 by use of motor control data. The motor 18 and/or motor controller provide the motor control data to an input 233 of a processor 23. A label edge sensor or blackmark sensor 22 detects the position of an edge of a label on the strip of labels and provides this information to an input 232 of the processor 23. The label edge sensor or blackmark sensor 22 can provide information about the front edge or the rear edge of a label when a label passes the position of the sensor 22. This information is needed to control the print head 15, in order that the printed image is synchronized to the position of the label. The processor 23 further includes an internal clock 231, which generates a time stamp if a label edge signal is received at the input 232 of the processor 23. The processor 23 generates a label start indicator using the time stamp, if the signal received indicates the front edge of the label and the processor 23 generates a label end indicator using the timestamp if the signal received indicates a rear end of the label. Even if the label edge sensor or blackmark sensor 22 cannot distinguish between a front edge and a rear edge of a label, the processor 23 can clearly determine if it is the front edge or the rear edge, as a rear edge always follows a front edge and vice versa. The distance from a front edge of a label to the rear edge of the same label is a label length L. The distance from the rear edge of a label to the front edge of the consecutive label is the distance G. The distance G is the gap between two labels and is much shorter than the label length L. By knowing the motor control data, it is possible to determine the distance between two label edge signals and to determine which one is a label start signal and which one is a label end signal. The processor 23 further includes a calculator 234 for calculating a label length indicator. The calculator 234 uses motor control data and the label start indicator and the label stop indicator for calculating a corresponding label length indicator. The label length indicator may either be a number of turns of the platen roller 16, expressed in degrees, or a label length. If it is a label length, it is not the real label length L. Rather, this calculation assumes that the printing apparatus 10 is an unweared system and platen roller 16, print head 15, coupler 19 and belt 20 are not affected by wearing effects. Thus, in a real system during use, this calculation gives not necessarily the real physical length of the label. This is also described in more detail with regard to FIG. 3 below. The processor 23 further includes a storage 235 for storing the label length indicator. The storage 235 does not only store the actual label length indicator but also a series of historic label length indicators which were determined in the past. The processor 23 further includes an envelope and maxima calculator 236 for calculating an envelope from the stored label length indicators. This means, the envelope and maxima calculator 236 is for generating an envelope function (curve) from the stored label length indicator by a mathematical function. The envelope may in the most cases be defined numerically, that means by a vector or matrix. In other cases, the envelope may be approximated by an analytical function. When a new label length indicator is generated, the existing envelope is updated with the new data. Thus, the envelope represents historic data of label length indicators calculated in a certain time interval. The envelope is updated continuously during the time interval. After a certain time interval, e.g. each after one day, after one week or after a month, the envelope is saved in the storage 235 and a new envelope is generated by the envelope and maxima calculator 236, wherein the new envelope represents the determined label length indicators for the next time interval. The envelope and maxima calculator 236 is according to one embodiment, for calculating the local maxima of the envelope. According to one embodiment, the processor 23 further includes a determinator 237 for determining a wearing indicator of the printing apparatus 10. In one embodiment, at least the determinator 237 is omitted and determination of the wearing indicator is made in a computing cloud as described below. The processor 23 further includes a communication unit 238, which is electrically coupled to a transmitter 24 for data exchange between the processor 23 and a network. The exchanged data are at least one of label length indicators, envelopes representing label length indicators, maxima of the envelopes, wearing indicators and other related data like time information and error information. The transmitter 24 connects the printing apparatus 10 via LAN, WLAN or other network technology to a network and to a computing cloud 25. The computing cloud 25 at least includes a data storage unit 251 including at least one memory device configured to store instructions and data and at least one computer processing unit 252 configured to execute instructions. Computer terminals 26 for end users are present and connected by a network to the computing cloud 25. The end users access the computing cloud 25 via the computer terminals 26 to access the information provided by the printing apparatus 10 and to get access to analysis and evaluation of the data provided by the computing cloud 25. In one embodiment, determining a wearing indicator is performed by the data storage unit 251 and the computer processing unit 252 of the computing cloud 25.

Figure 3:
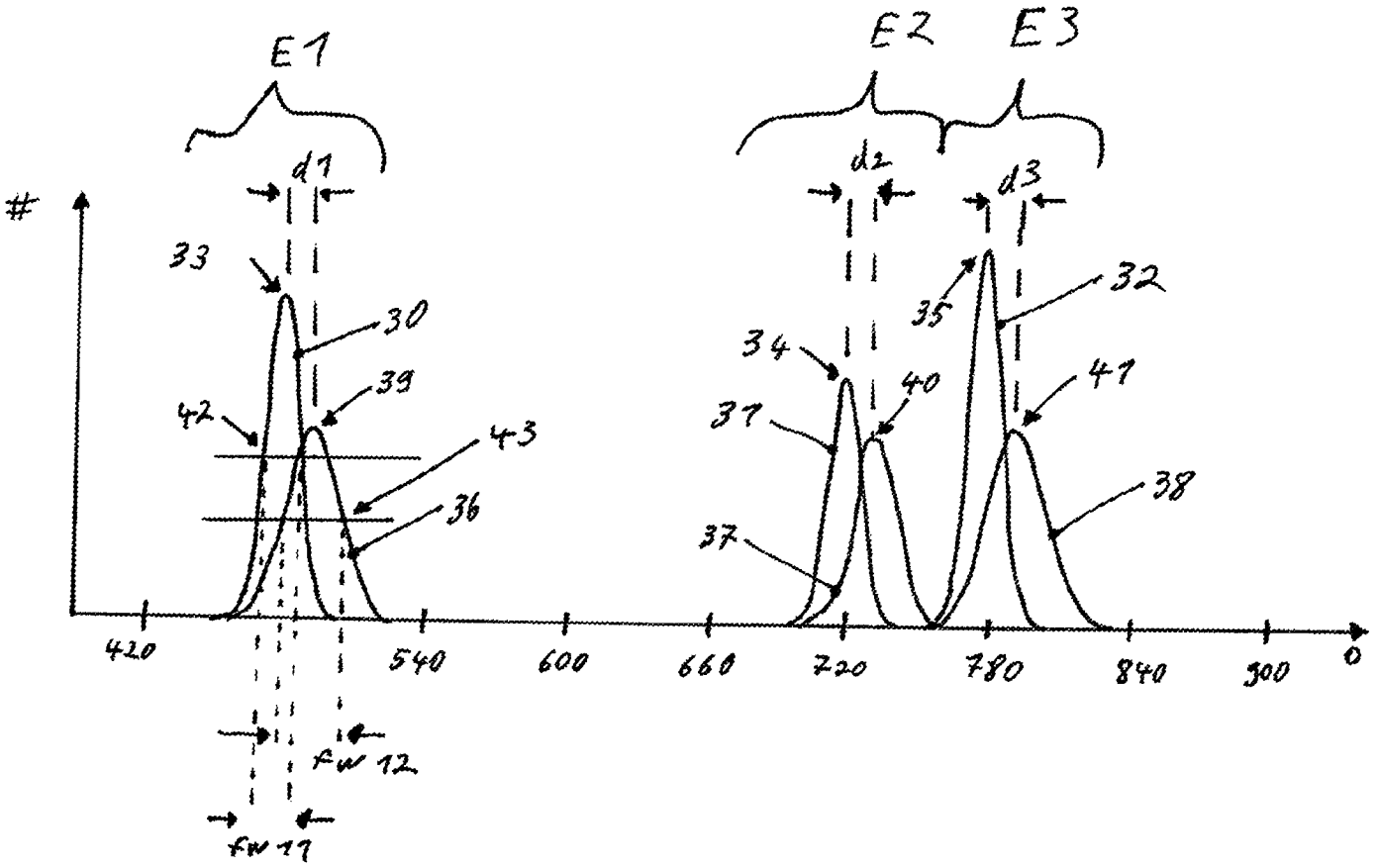
FIG. 3 schematically depicts a diagram with envelopes of label length indicators determined during two different time intervals.

FIG. 3 schematically depicts envelopes of label length indicators as determined by the printing apparatus and the method for determining wearing of the printing apparatus. By way of an illustrative example only, FIG. 3 depicts envelopes of label length indicators of three label types E1, E2, E3 with three different label lengths. The y-axis represents the number of label length indicators in relation to corresponding degree of turns of the platen roller on the x-axis. The number of turns of the platen roller expressed in degrees are derived from the motor control data during printing.

A first envelope 30, 31, 32 representing the label length indicators determined during a first time interval and a second envelope 36, 37, 38 representing the label length indicators determined during a second time interval are shown. The first section 30 of the first envelope represents label length indicators that were determined during a first time interval when a first label type E1 was printed. The second section 31 of the first envelope represents label length indicators that were determined during a first time interval when a second label type E2 was printed. The third section 32 of the first envelope represents label length indicators that were determined during a first time interval when a third label type E3 was printed. The label length L of the third label type E3 is the longest, the label length L of the first label type E1 is the shortest. The first section 36 of the second envelope represents label length indicators that were determined during a second time interval when a first label type E1 was printed. The second section 37 of the second envelope represents label length indicators that were determined during a second time interval when a second label type E2 was printed. The third section 38 of the second envelope represents label length indicators that were determined during a second time interval when a third label type E3 was printed. Each section 30, 31, 32, 36, 37, 38 of an envelope has a corresponding (local) maxima 33, 34, 35, 39, 40, 41. The maximum 39 of the first section 36 of the second envelope representing label length indicators that were determined during the second time interval when the first label type E1 was printed is shifted by a distance d1 to the right on the x-axis compared to the maximum 33 of the first section 30 of the first envelope representing label length indicators that were determined during a first time interval when the first label type E1 was printed. This shift of the maximum 33, 39 between the first time interval and the second time interval in x-direction to the right indicates that the platen roller or drawing off roller needs more turns (more degrees of rotation) to transport a label of the first label type E1. From this, it is clear that in the second time interval more wearing is present in the printing apparatus than in the first time interval. The same result is discovered when the distances d2, d3 between the maxima 34, 40, 35, 41 of the first time interval and the second time interval with regard to the other two label types E1, E2 are evaluated. FIG. 3 further depicts the full width half maximum value of the first section 30 of the first envelope, which is defined as the width fw11 of the curve at the half 42 of the maximum value 33. The full width half maximum fw12 for the first section of the second envelope is also indicated. This width fw12 is bigger compared to the width fw11 of the first envelope. This also indicates increased wearing of the printing apparatus in the second time interval compared to the first time interval. Both parameters, the shift of the maximum and the width of the full width half maximum are statistical values. They do not evaluate and analysis a single print. The envelopes, which are analyzed, represent multiple prints during a time interval. It is clear from the figure that it is irrelevant for the method how often the labels are changed during one time interval. During a time interval, when a label length indicator is determined, the label length indicator is added to the envelope function of this time interval, wherein the x-axis represents the corresponding label length indicator and the y-axis corresponds to the number this label length indicator occurred. Of course, the first section 30 of the first envelope and the first section 36 of the second envelope do not necessarily represent the same number of label length indicators, as it is not clear if the same numbers of labels of a first type were printing during the first time interval and during the second time interval. For sake of completeness only, if the first section 30 of the first envelope and the first section 36 of the second envelope would represent the same number of label length indicators, during the first time interval, where less wearing is present, the curve is higher and smaller and during the second time interval, where more wearing is present, the curve is extended in width direction. This shows the less ideal conditions of a printing apparatus suffering from wearing effects. In an ideal printing apparatus, this curve would be a bar at a single point of the x-axis. Also, the label length L may have tolerances which could also affect the determined label length indicators. In real life, the tolerances of the label length L are neglectable compared to the wearing effects of the printing apparatus.

Figure 4:
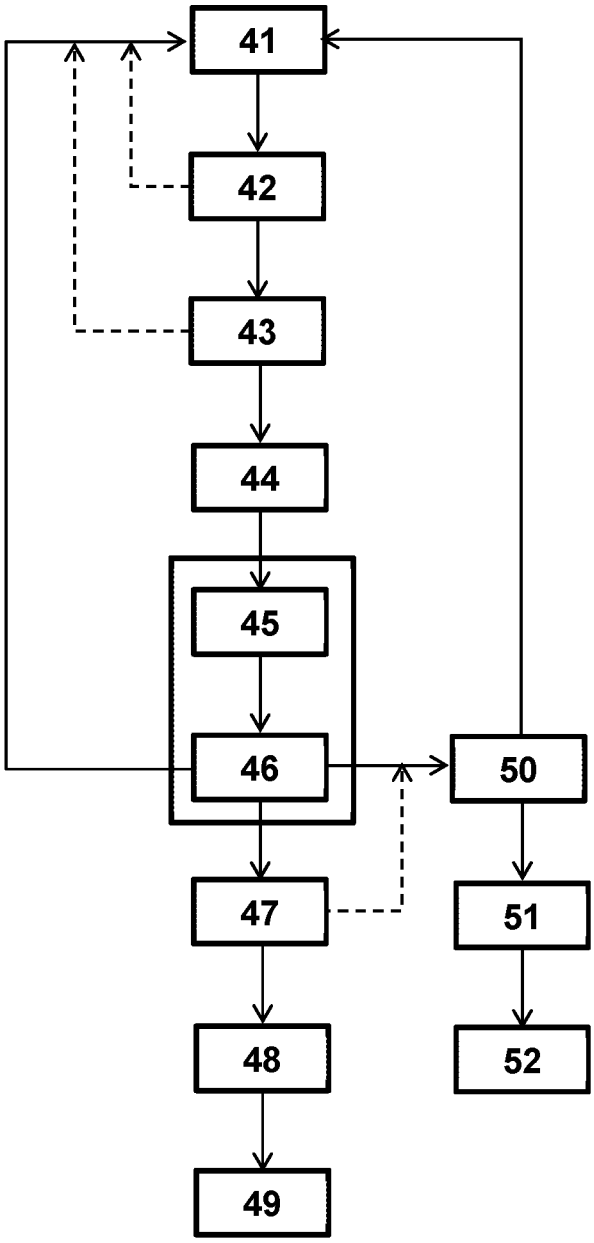
FIG. 4 schematically depicts a method for determining wearing of a printing apparatus according to the invention.

FIG. 4 schematically depicts a method for determining wearing of a printing apparatus. In step 41, the apparatus starts printing of a label of the label length L. The motor is controlled by motor control data for the printing process. The motor drives the platen roller and/or drawing off roller. In step 42, a label start indicator is determined when a front edge of a label passes a label edge sensor. In step 43, a label end indicator is determined when a rear edge of the label passes a label edge sensor. The determination of the label start indicator or label end indicator may alternatively also be based on blackmarks and a signal of a blackmark sensor. From the label start indicator and the label end indicator and the motor control data of the time between the label start indicator and the label end indicator, a label length indicator is determined in step 44. The label length indicator corresponds directly do the number of rotations of the roller driven by the motor which were needed to transport the label below the label edge sensor. It is understood that the motor is running and controlled during the whole printing process and not only at the beginning of the printing process. Thus, step 41 is executed until the printing process is ended and overlays with steps 42 and 43. The output of the label edge sensor is also used to control the printing process. This is indicated by the dashed lines. After the label length indicator is determined, the label length indicator is stored in the printing apparatus in step 45 and an envelope (function) representing label length indicators of a present time interval is updated in step 46. The envelope represents label length indicators of a time interval which has a duration in which the wearing is not increased significantly. Thus, after such a time interval, a new envelope function is generated and updated, which is not explicitly represented in FIG. 4. Afterwards, the next label is printed in step 41. In step 47 and when envelope functions of multiple time intervals are available, shifts of maxima of one section of envelopes of different time intervals are determined. One section of an envelope represents label length indicators of labels of the same length. Of course, label length indicators change significantly if the label which are printed are changed and have a different length. In step 46, when the envelope function is updated, the real label length is irrelevant und does not need to be determined. There is also no need to determine which label type E1, E2, E3 is actually printed. The envelope simply gives a function of the number how often a label length indicator occurred. During each time interval, this function has a local maxima for each label type E1, E2, E3. In step 47, local maxima of the envelope are determined. As the maxima of the envelope vary slowly, this determination may not be performed each time the envelope is updated but on a regular basis. Further, in step 47, the shifts of the local maxima of envelopes of different time intervals are determined in the printing apparatus. In step 48, from the shifts of the local maxima of the envelopes of different time intervals, a wearing indicator is determined. Alternatively or in addition, not only the local maxima is determined and evaluated in steps 46 to 48, but also the full with half maximum of the peaks of the envelopes are determined and evaluated. In step 49, in case the wearing indicator exceeds a threshold, the printing apparatus displays on a display or sends via a network a message that the printing apparatus needs to be serviced or a platen roller and/or drawing off roller needs to be replaced. Alternatively or in addition to steps 47 to 49, in step 50, the envelopes are sent to a computing cloud on a regular basis. In the computing cloud, in step 51, a processor determines the local maxima and the shifts of the local maxima of envelopes of different time intervals and determines a wearing factor from these values. In step 52, in case the wearing indicator exceeds a threshold, the printing apparatus displays on a display or sends via a network a message that the printing apparatus needs to be serviced or a platen roller and/or drawing off roller needs to be replaced. Alternatively, the printing apparatus determines the maxima of the envelopes in step 47 and sends these values to the computing cloud in step 50.

The functions of the various elements shown in the Figures, including any functional blocks, may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, the functions may be provided, without limitation, by digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method for determining wearing of a printing apparatus, the method comprising:

controlling a motor of a label paper driving mechanism of the printing apparatus using motor control data;

determining a label start indicator;

determining a label end indicator;

determining a label length indicator corresponding to a length covered by a rotation of the label paper driving mechanism of an unweared printing apparatus between the label start indicator and the label end indicator based on the motor control data;

storing the label length indicator; and determining a wearing indicator of the printing apparatus based on stored label length indicators, including the label length indicator.

2. The method for determining wearing of the printing apparatus according to claim 1, wherein the label start indicator and the label end indicator are determined by a label edge sensor or a blackmark sensor.

3. The method for determining wearing of the printing apparatus according to claim 1, wherein the printing apparatus has an internal clock and the label start indicator and the label end indicator are time stamps based on the internal clock of the printing apparatus.

4. The method for determining wearing of the printing apparatus according to claim 1, wherein the label length indicator corresponds to a number of rotations of a platen roller and/or a drawing off roller of the label paper driving mechanism within a time frame between the label start indicator and the label end indicator.

5. The method for determining wearing of the printing apparatus according to claim 1, wherein the step of storing the label length indicator comprises a step of updating with the determined label length indicator an envelope representing label length indicators within a predefined time interval.

6. The method for determining wearing of the printing apparatus according to claim 5, further comprising a step of determining local maxima of the envelope.

7. The method for determining wearing of the printing apparatus according to claim 1, further comprising a step of transmitting label length indicators, and determined envelopes and/or local maxima of the determined envelopes to a computing cloud.

8. The method for determining wearing of the printing apparatus according to claim 1, wherein the wearing indicator is determined on a basis of a shift of the label length indicators and/or of corresponding envelopes and/or a shift of maxima of corresponding envelopes.

9. The method for determining wearing of the printing apparatus according to claim 1, wherein the label length indicator, the corresponding envelope and/or the maxima of the corresponding envelopes are compared to length data related to the label stored in a database.

10. A printing apparatus comprising a printing mechanism for printing label paper, comprising:

a print head unit;

a label paper driving mechanism including at least a motor and a driven transport roller;

a label edge sensor and/or a blackmark sensor; and a processor with at least an input for receiving motor control data and an input for receiving an output of the label edge sensor and/or blackmark sensor, wherein the processor further comprises a calculator for calculating a label length indicator from motor control data and the received signal of the label edge sensor and/or the blackmark sensor, and the label length indicator corresponds to a length covered by a rotation of the label paper driving mechanism of an unweared printing apparatus when the label paper driving mechanism is controlled by the motor control data between a time of receiving a label start indicator and a label end indicator from the label edge sensor and/or blackmark sensor; and a storage for storing label length indicators, including the label length indicator.

11. The printing apparatus according to claim 10, further comprising an internal clock, wherein the label edge sensor and/or the blackmark sensor generate a time stamp when a label edge and/or blackmark is detected and provide the time stamp at the output.

12. The printing apparatus according to claim 10, wherein the processor comprises an envelope calculator for determining an envelope representing the label length indicators calculated during a predetermined time interval and for calculating local maxima of the envelope.

13. The printing apparatus according to claim 10, wherein the processor further comprises a determinator for determining a wearing indicator of the printing apparatus based on stored historic length indicators.

14. The printing apparatus according to claim 10, wherein the printing apparatus comprises a transmitter for repeatedly transmitting the label length indicators and/or envelopes representing the label length indicators and/or local maxima of the envelopes representing the label length indicators to a computing cloud.

15. A system for determining wearing of a printing apparatus, the system comprising:

at least one printing apparatus according to claim 10; and a computing cloud comprising:

at least one data storage unit comprising at least one memory device configured to store instructions and data, and at least one computer processing unit configured to execute the instructions, wherein the computing cloud is configured to:

receive label length indicators and/or envelopes representing the label length indicators and/or local maxima of envelopes representing the label length indicators, detect shift of the received label length indicators and/or the received envelopes and/or the received local maxima, determine a wearing indicator of the at least one printing apparatus based on the detected shifts, and instruct at least one client device associated with the computing cloud if the wearing indicator reaches a first threshold and/or a deviation of the wearing indicator reaches a second threshold.

16. The printing apparatus according to claim 10, wherein the printing mechanism is in the form of label paper rolls, and the driven transport roller is a driven platen roller and/or a driven drawing off roller.

* * * * *